US010648173B1

(12) United States Patent
Harkins

(10) Patent No.: US 10,648,173 B1
(45) Date of Patent: May 12, 2020

(54) PRESSURE ABSORBING EXPANSION SPACERS

(71) Applicant: Daniel J. Harkins, Port Charlotte, FL (US)

(72) Inventor: Daniel J. Harkins, Port Charlotte, FL (US)

( * ) Notice: Subject to any disclaimer, the term of this patent is extended or adjusted under 35 U.S.C. 154(b) by 0 days.

(21) Appl. No.: 16/592,111

(22) Filed: Oct. 3, 2019

Related U.S. Application Data

(63) Continuation-in-part of application No. 16/382,262, filed on Apr. 12, 2019, now Pat. No. 10,472,831, which is a continuation-in-part of application No. 15/957,237, filed on Apr. 19, 2018, now Pat. No. 10,301,818.

(51) Int. Cl.
*E04B 1/84* (2006.01)
*E04B 7/02* (2006.01)
*E04B 1/24* (2006.01)

(52) U.S. Cl.
CPC ..... *E04B 1/84* (2013.01); *E04B 1/24* (2013.01); *E04B 7/024* (2013.01)

(58) Field of Classification Search
CPC ..... E04B 1/7654; E04B 7/024; E04B 1/24; E04B 1/7666; E04D 13/1625; E04D 13/1618
See application file for complete search history.

(56) References Cited

U.S. PATENT DOCUMENTS 2,749,262 A * 6/1956 Wiser ..... E04B 1/7654 52/406.3
2,782,914 A * 2/1957 Giles ..... E04B 1/7654 428/101
3,513,614 A * 5/1970 Studzinski ..... E04D 13/1618 52/742.12
3,774,366 A * 11/1973 Baker ..... E04B 9/064 52/664
4,058,949 A * 11/1977 Bellem ..... E04D 3/3602 52/407.1
4,233,791 A * 11/1980 Kuhl ..... E04B 1/66 156/71
4,346,543 A * 8/1982 Wilson ..... E04D 3/3602 52/404.2
4,434,601 A * 3/1984 Zellmer ..... E04D 13/1625 52/407.1

(Continued)

*Primary Examiner* — Rodney Mintz
(74) *Attorney, Agent, or Firm* — Donald J. Ersler

(57) ABSTRACT

An insulation support system preferably includes an edge-folded ceiling liner sheet, an encapsulated package and a plurality of compressible thermal spacers. The edge-folded ceiling liner sheet includes opposed folded-up edges. The folded-up edges have sufficient length to clear pinch points along structural beams. The edge-folded ceiling liner sheet is fan-folded for retention in the encapsulated package. A pressure absorbing expansion spacer prevents roof or wall panel rumble noises and may be applied directly to roof or wall structural members, or may include a snap clip bonded to a pressure absorbing expansion spacer material. A bottom of the pressure absorbing expansion material is bonded to a top of the snap clip. The snap clip is attached to flanges of purlins or girts eliminating the need for stand-off roof panel clips, rigid thermal blocks and severe compression of an extra layer of blanket fiber glass insulation.

15 Claims, 12 Drawing Sheets

(56) References Cited

U.S. PATENT DOCUMENTS 4,446,664 A 5/1984 Harkins
4,566,239 A * 1/1986 Smigel ..... E04B 1/7666 24/460
4,573,298 A 3/1986 Harkins
4,875,320 A * 10/1989 Sparkes ..... E04B 9/001 52/406.1
5,085,023 A * 2/1992 Duffy ..... E04D 13/1625 52/407.4
5,367,848 A * 11/1994 McConnohie ..... E04D 3/3608 52/334
5,901,518 A 5/1999 Harkins
6,625,950 B1 * 9/2003 Shreiner ..... E04F 11/1804 52/288.1
6,708,463 B2 * 3/2004 Chai ..... E04D 1/06 52/470
7,913,842 B2 * 3/2011 Evans ..... B65D 75/5827 206/388
8,333,279 B2 * 12/2012 Veiseh ..... B65B 5/067 206/524.8
8,371,083 B2 * 2/2013 Chamberlin ..... E04D 3/3608 52/404.1
8,590,234 B2 * 11/2013 Groft ..... E04D 13/1625 52/302.1
8,590,245 B2 * 11/2013 Peng ..... E04D 13/1618 52/404.3
8,627,628 B2 * 1/2014 McClure ..... E04D 13/1618 52/404.1
8,739,486 B2 * 6/2014 Bodsford ..... E04H 5/10 52/404.2
8,752,344 B1 * 6/2014 Morris ..... F24F 7/02 285/371
9,290,930 B2 * 3/2016 Beals ..... E04B 1/665
9,546,480 B2 * 1/2017 Jakobsen ..... E04D 3/36
9,580,909 B2 * 2/2017 Hostetler ..... E04D 3/3602
9,725,903 B2 * 8/2017 Hostetler ..... E04D 3/3601
9,739,060 B2 * 8/2017 Beals ..... E04C 2/46
9,920,517 B2 * 3/2018 Sollie ..... E04B 1/80
10,301,818 B1 * 5/2019 Harkins ..... E04D 13/16
10,472,831 B1 * 11/2019 Harkins ..... E04D 13/1618
2003/0159398 A1 * 8/2003 Chai ..... E04D 1/06 52/746.11
2004/0185225 A1 * 9/2004 Fay ..... E04B 1/767 428/126
2009/0314672 A1 * 12/2009 Evans ..... B65D 75/5827 206/321
2011/0061311 A1 * 3/2011 Peng ..... E04D 13/1618 52/23
2011/0094175 A1 * 4/2011 Groft ..... E04D 13/1618 52/302.1
2011/0154769 A1 * 6/2011 Oberg ..... E04D 3/3603 52/582.1
2011/0173913 A1 * 7/2011 Bodsford ..... E04H 5/10 52/407.4
2012/0079775 A1 * 4/2012 Chamberlin ..... E04D 3/3608 52/90.1
2012/0124930 A1 * 5/2012 McClure ..... E04D 3/364 52/404.3
2012/0255252 A1 * 10/2012 McClure ..... E04D 3/3602 52/404.1
2015/0082725 A1 * 3/2015 Beals ..... E04B 1/665 52/410
2016/0130801 A1 * 5/2016 Jakobsen ..... E04D 3/36 52/90.1
2016/0160503 A1 * 6/2016 Beals ..... E04C 2/46 52/408
2016/0237687 A1 * 8/2016 Hostetler ..... E04D 3/3602
2016/0244964 A1 * 8/2016 Hostetler ..... E04D 3/3601
2018/0051460 A1 * 2/2018 Sollie ..... E04B 1/80
2019/0100920 A1 * 4/2019 Krause ..... E04D 3/362

* cited by examiner

PRESSURE ABSORBING EXPANSION SPACERS

CROSS-REFERENCES TO RELATED APPLICATIONS

This a continuation-in-part patent application, which takes priority from patent application Ser. No. 16/382,262, filed on Apr. 12, 2019, which takes priority from patent application Ser. No. 15/957,237, filed on Apr. 19, 2018.

BACKGROUND OF THE INVENTION

1. Field of the Invention

The present invention relates generally to sheet metal panel sheeted buildings and more specifically to pressure absorbing expansion spacers for installation between the metal roof or wall sheeting and their respective underlying structural members to absorb undulating movements of the metal sheeting caused by fluctuating wind pressures on the metal sheeting panels, which cause an interior rumbling noise similar to storm thunder. This allows for the installation of metal roof and wall sheeting, while eliminating the need for a continuous outer layer of compressed blanket insulation installed in severe compression between an underside of the metal roof panel sheeted areas and the upper side of the underlying structural members to dampen roof noise. This allows the thermal insulation to be installed completely uncompressed between the secondary structural members from the outside during the metal roof panel sheeting process or completely from the building interior after the metal roof sheeting is installed. This interior installation also allows for the rapid enclosure of the building to minimize the adverse effects of all weather variables such as wind, rain, snow, etc on all subsequent construction, which results in productivity being increased.

2. Discussion of the Prior Art

Insulation systems for buildings with primary roof beams attached and supported by columns attached to a foundation with bolts, and which buildings have secondary structural members substantially perpendicular to and supported by the primary rafter beams and columns, also known as metal buildings have been developing to achieve higher thermal insulating performances as disclosed in U.S. Pat. Nos. 4,446,664, 4,573,298 and 5,901,518 to Harkins. The basic concepts are to use methods and structures to retain the insulation materials of various types with greater thicknesses and with minimal compression. Insulative materials generally have thermal resistances that are determined by the installed thickness of the insulative materials used. Various methods and structures have been devised to create support structures for the insulation materials, which create space for greater thicknesses of insulation materials in the building roofs and walls with less insulation compression and significantly greater thermal resistance performance. Some of these insulation methods employ very large pieces of flexible sheet materials that are custom pre-fabricated to fit between each of the building's primary structural beam spacings, and span below a plurality of perpendicular secondary structural members without a need for sealed seams to be made during the installation process at each secondary structural member as illustrated in prior art.

The prior art uses of a lattice of straps, wires, ropes or bands to create a lattice support structure and more recently structural ceiling support struts, which span between the primary support beams or rafters and are installed to support the large pieces of flexible sheet material as it is installed, clamped and fastened into position, and then sealed along all edges of the sheet material. The installations of the support platform and the large flexible sheet are typically done in sequence with the insulation materials and roof panel sheeting materials. These methods and structures used to practice these inventions are typically done in exposed exterior weather conditions which have wind, rain, snow and other weather related phenomena, which adversely affect the exposed materials used, the productivity of the installers, the aesthetics and quality of the installed flexible sheet materials, and the final resulting insulation performance.

During installation, the exposed flexible sheet materials are easily caught by wind during installation and also can collect rain, sleet and snow during the process of installation of the large flexible sheets of materials, which are custom pre-fabricated to fit entire building bay areas between two adjacent primary rafter beams, and below a plurality of secondary structural members which typically cover the entire width of the building between the two opposing sidewalls in one continuous seamless piece covering up to many thousands of square feet. Insulation is typically two layers with the bottom layer placed between the secondary structural members and supported directly on the flexible sheet material, which is in turn supported by the lattice of straps, wires, ropes, bands or struts which retain the flexible sheet material below the bottom plane of the secondary structural members. A second layer of insulation, which is typically in a blanket form is placed over the upper side secondary structural members and the upper side of the first layer of insulation, which is between the purlins. Roofing panels are typically installed over the top of the insulation by compressing the insulation and the panels fastened through the compressed insulation and into the top side of the purlins to form the building roof.

The insulation typically fills the space between the flexible sheet material supporting the insulation and the underside of the roof panels. The second insulation layer of blanket insulation is typically installed completely covering the first insulation layer, sandwiched between the exterior sides of the secondary structural members and the underside of the roof panels with the gravitational weight of the blanket insulation holding the insulation temporarily in place. This second layer of insulation, typically severely compressed fiber glass, serves primarily to break the conductive contact between the thermally conductive secondary structural members, typically called purlins or joists, which are typically metal and the thermally conductive metal roof panels, which may be made of steel, aluminum, or other materials. Similar layers of insulation may also be used on metal sheeted building walls which typically require adhered insulation facings, hangers or washered-fasteners to vertically support the wall insulation during the wall sheeting process similar to the roof sheeting process.

Installing the thicker insulation systems which are typically comprised of two or more insulation layers and their support system is more time consuming than that of the prior art, which has been typically draping one thin layer of faced blanket insulation over the exterior facing sides of the secondary structural members in roofs and walls, with gravitational weight and washered-fasteners temporarily holding the faced blanket insulation in place, compressing it under the roof or wall panels and fastening the panels with panel fastener that penetrate through the compressed faced blanket insulation. A similar process is used to install the wall insulation and exterior wall sheeting materials into secondary wall structural members, typically called girts or purlins. The extra time required to install an insulation support system and with several hundred percent more insulation thickness has resulted in additional exposure time to weather elements which have resulted in the need for improvements in the insulation systems of these buildings, which speed up the installation process, reduce the exposure time to inclement weather, reduce potential project delays and improve the quality of the installations and their installed thermal performance.

So there is a need for an improved system that reduces exposure to weather, speeds up the installation time and provide new structures that include better options for contractors to select from their particular project environment, including systems that can completely be installed from the interior of a sheeted building, out of the weather elements and also which avoid the problems of roof and wall sheeting panel noises, commonly called roof rumble, which are the result of undulating sheeting panel surfaces caused by variable wind pressures undulating the building metal sheeting panels between fastening points.

There is a need for an insulation system with an encapsulated ceiling liner sheet which preserves the ceiling liner sheet in a uniform, fan-folded form inside of an encapsulating package whereby the package is not only used for protecting the ceiling liner sheet in the perfect fan-folded (pleat) format from the point of manufacture to the point of clamping the ceiling liner sheet in final position. Prior art systems required the ceiling liner sheet to be removed from it's wrapping and the unwrapped ceiling liner sheet folds are all exposed to the wind and unprotected as the unwrapped fan-folded ceiling liner sheet is positioned on the lattice platform of straps between two adjacent secondary structural members. The ceiling liner sheet is typically difficult to keep in the neat fan-folded format as there is nothing to hold it neatly in position as the top end of the sheet is pulled off the pleat-folded pile of ceiling liner sheet. Wind often disturbs the fan-folded ceiling liner sheet during the process causing it to unfold and catch on the roof structural members. This then requires minimal wind conditions or additional workmen to hold, release and guide the fan-folded ceiling liner sheet one fold at a time as the top end of the ceiling liner sheet is pulled off the pleat-folded pile and across the lattice support platform.

Another problem that is routinely encountered is the ceiling liner sheet is wider than the distance between the two adjacent rafter beam edges. The extra width is required to lap and seal the side edges of the ceiling liner sheet to the top of both of the adjacent primary structural beams, also referred to as building rafters. This extra width occasionally catches in pinch-points where the secondary structural members and purlins are attached to top sides of the primary structural beams (rafters).

Accordingly, there is a clearly felt need in the art for an insulation support system, which avoids frequent pinch points along primary structural beams and a pressure absorbing expansion spacer, which abates roof rumble noise and also eliminates the need for one complete layer of insulation blanket and allows the installation of one thicker layer of insulation between secondary structural members from the top side of the roof during the roof panel sheeting process or completely from the interior of the building after the building wall and roof sheeting panels are installed. This saves time, reduces material costs and improves the quality and thermal performance of the building.

SUMMARY OF THE INVENTION

The present invention provides an insulation support system, which avoids frequent pinch points along primary structural beams. The insulation support system preferably includes an edge-folded ceiling liner sheet, an encapsulated package and a plurality of pressure absorbing expansion spacers. The edge-folded ceiling liner sheet having opposing side edges folded back over a ceiling liner sheet edge, a distance sufficient for the pre-folded edge to clear the frequent pinch points along both adjacent primary structural beams. The opposing edge folds of the ceiling liner sheet are pre-creased on the fold to hold the proper fold distance dimension throughout the installation on a lattice support platform of crossing support straps to avoid the pinch points as well as clearance to fit neatly into the encapsulated package. The edge-folded ceiling liner sheet is fan-folded (pleat-folded) in a dimension sufficient to be retained neatly in an encapsulated package; and the pre-folded edges are inside the opposite two narrower ends of the encapsulated package.

At least one of the long package edges includes a sheet slot formed through an elongated side of the encapsulated package. The sheet slot is covered with a removable seal strip. The edge seal strip is removed once the encapsulated package containing the neatly fan-folded ceiling liner sheet is placed into position on the lattice platform between the chosen secondary structural members, typically adjacent the building eave line or ridge line. When workmen are ready to pull out the ceiling liner sheet in the desired building bay between two adjacent primary structural beams, the removable slot seal strip is pulled off the encapsulated package and two crew men take only the opposing top corners of the ceiling liner sheet out of the encapsulating package and quickly pull the ceiling liner sheet out below the secondary structural members on the top side of the lattice platform with negligible adverse effects of wind and without the fan-folds and edges being caught at pinch points. The fan-folded ceiling liner sheet remains protected inside the encapsulated package out of any wind and other potential weather exposures. A board or other weights can be placed on the top of the encapsulated package to provide an additional desired degree of resistance to the fan-folded ceiling liner sheet inside the package from being pulled out of the encapsulated package.

Another option is to clamp two opposing top end corners of the ceiling liner sheet at the beginning end to the building structural member such as an eave or ridge purlin and then pull the encapsulated package along on the lattice platform as the ceiling liner sheet pulls out of the side slit on the side of the encapsulated package. The length of the encapsulated package is less than the distance between the two adjacent primary structural members to avoid any interference with pulling the encapsulated package or sheet along on the lattice platform. With either option, once the ceiling liner sheet is pulled into its final position and temporarily clamped squarely and securely in position, the bottom side fasteners are installed to attach the lattice platform to the bottoms of the secondary structural members with fasteners penetrating through the strap and over-laying ceiling liner sheet at those fastening points. The ceiling liner sheet folded edges are unfolded, trimmed and sealed neatly to the top flanges of the primary structural members.

It is an option to install the insulation from the interior of the building after the roof panels are installed. For this option to be used, there is a need for a pressure absorbing expansion spacer material to be installed on top of the secondary structural members, before the roof panels are applied. The pressure absorbing expansion spacer may be attached by any means to the exterior side of the secondary structural member and dampens any roof noises from rain and wind actions on the metal sheeting panels. Roof panels must be prevented from flexing by use of the pressure absorbing expansion spacers to prevent roof rumble noise, which can be very loud, thunder-like sounds and very annoying to interior building occupants. It is preferable that the expansion spacer be preloaded, such that a height of the expansion spacer is decreased. The expansion spacer is preloaded between a roof or wall and a support structure, second roof or second wall. It is also preferable that the expansion spacer have memory, such that it returns to its original shape, after removal from a compressed state.

Similarly when buildings require replacement roofs and or replacement wall panels for various reasons, it is possible install additional secondary structural members such as roof purlins or wall girts on top of, or to the exterior face of the existing roof or wall panels that are deliberately left in place. The pressure absorbing expansion spacers similarly need to be used on the exterior sides of added roof purlins and added wall girts to perform the functions of preventing roof or wall rumble noises resulting from installing new roof or wall panels to the exterior sides of the new secondary structural members such as purlins, girts and others structural shapes.

More stringent energy conservation codes are requiring much greater insulation thicknesses with greater insulation performances in building roofs and walls. These greater stringencies require use of different methods, which create space for greater thicknesses of insulation necessary to meet and exceed the higher thermal insulation requirements. Typically, a facing sheet material is adhered or laminated to an insulation material such as blanket fiberglass. This laminated insulation sheet material is installed between the roof secondary structural members and is supported by steel support straps which are installed substantially perpendicular, across the underside of these roof secondary structural members such as metal building roof purlins. The side edges and end butt junctions of each of the individual laminated insulation sheet materials are then required to be sealed together over the tops of secondary roof structural members, which are not practically and economically possible to seal effectively from above as such structural members are typically spaced from four to five feet apart, beyond the reach of workmen standing in a lift basket. This sealing of the laminated insulation sheet material joints is to resist air and water vapor leakage due to pressure differences and convection currents and required for optimal thermal performance of the insulation and to prevent moisture migration and condensation within the insulation cavity. Methods that place the vapor retarders over the upper surfaces of the secondary roof structural members, leave the bottom and sides of these structural members exposed to significant absorption, conduction and radiation of heat energy and will also promote condensation and corrosion problems during various outside temperature extremes as the temperature fall below the dew points of the air mixture abutting the metal secondary structure.

Superior methods incorporate the seamless ceiling liner sheets pulled-in continuously below the secondary structural members which eliminates the many problems associated with leaving exposed conductive secondary structural members including that of the sealing insulation facing tabs over the exterior side of every secondary roof or wall structural member, such as purlins, joists and trusses. Often these facing tab laps are not effectively sealed as these are hidden from view as the roof or wall panels are installed.

Accordingly, it is an object of the present invention to provide an insulation system utilizing edge-folded ceiling liner sheets to support insulation, which avoids frequent pinch points along primary structural beams; prevents damage to the ceiling liner sheet during installation processes; provides a practical means to unfold, trim and seal the ceiling liner sheet edges along the top rafter flanges, which effectively isolates all thermally conductive secondary structural members, such as purlins or trusses from the conditioned space air below, one bay at a time; and pressure absorbing expansion spacers, which allow the faster installation of roof and wall building thermal insulation one bay at a time from the interior of the building after the roof sheeting panels are installed including installing pressure absorbing expansion spacers to prevent roof rumble noise.

These and additional objects, advantages, features and benefits of the present invention will become apparent from the following specification.

DETAILED DESCRIPTION OF THE PREFERRED EMBODIMENTS

Figure 1:
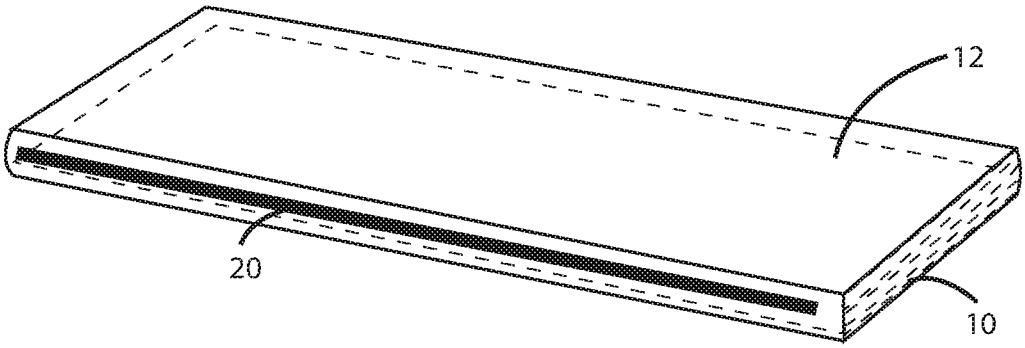
FIG. 1 is a perspective view of an encapsulated package of an insulation support system in accordance with the present invention.
Figure 2:
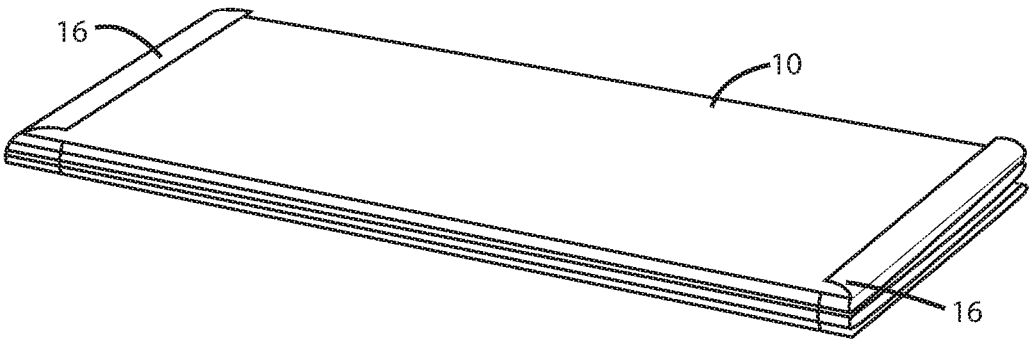
FIG. 2 is an edge-folded ceiling liner sheet removed from an encapsulated package of an insulation support system in accordance with the present invention.
Figure 3:
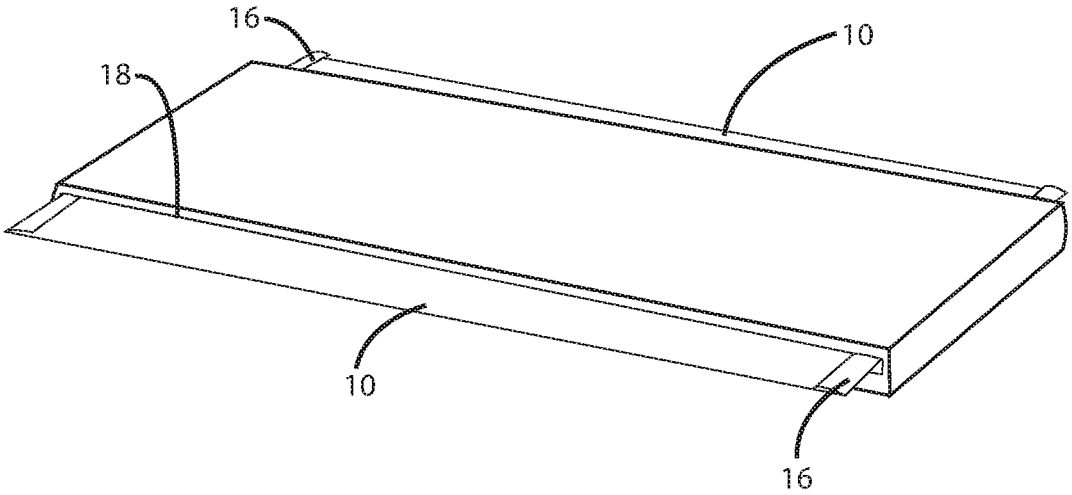
FIG. 3 is a perspective view of an encapsulated package with opposing edges of an edge-folded ceiling liner sheet extending from opposing ends of the encapsulated package of an insulation support system in accordance with the present invention.
Figure 4:
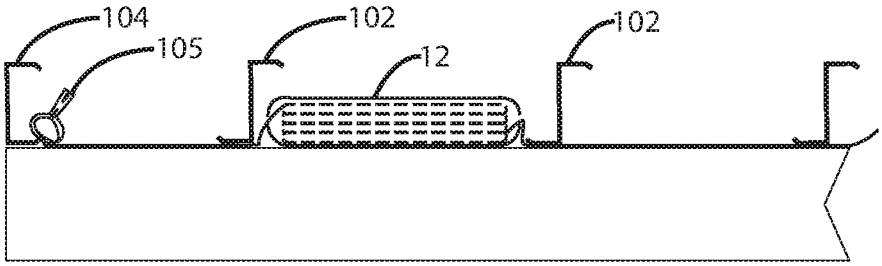
FIG. 4 is an end view an encapsulated package located between two adjacent purlins with an edge-folded ceiling liner sheet extending from opposing lengthwise sides of the encapsulated package of an insulation support system in accordance with the present invention.

With reference now to the drawings, and particularly to FIG. 1, there is shown a perspective view of an encapsulated package of an insulation support system. With reference to FIGS. 1-3, 5 and 11, the insulation support system preferably includes an edge-folded ceiling liner sheet 10, an encapsulated package 12 and a clip-on pressure absorbing expansion spacer 22. The encapsulated package 12 is also protected from the weather. The edge-folded ceiling liner sheet 10 includes opposed folded-up edges 16. With reference to FIGS. 3-4, the folded-up edges 16 have sufficient length to clear the frequent pinch points along both adjacent primary structural beams. The opposing folded-up edges 16 of the edge-folded ceiling liner sheet 10 are creased on the fold to fit neatly into the encapsulated package 12. The encapsulated package 12 has a substantially rectangular shape. The edge-folded ceiling liner sheet 10 is fan-folded in a dimension sufficient to be retained in the encapsulated package 12. With reference to FIGS. 1 and 3, a sheet slot 18 is formed through at least one lengthwise sidewall of the encapsulated package 12. A removable sheet slot seal strip 20 is applied over the sheet slot 18, until removal of the edge-folded ceiling liner sheet 10 from the encapsulated package 12.

With reference to FIGS. 3-7, the encapsulated package 12 is placed between purlins 102 or eave purlins 104 of a building support structure 100 on top of a plurality of support straps 106 (lattice support, many other support strap patterns not shown). The purlins 102, 104 are supported by rafters 108. When workmen are ready to pull out the edge-folded ceiling liner sheet 10 in a desired building bay, between two rafters 108, the removable sheet slot strip 20 is pulled off the encapsulated package 12 and two crew men take only the opposing top corners of the edge-folded ceiling liner sheet 10 out of the encapsulated package 12 through the sheet slot and quickly pull the edge-folded ceiling liner sheet 10 out of the encapsulated package below the purlins 102 (secondary structural members) on a top side of the plurality of support straps 106 (lattice support) as the edge folded liner sheet unfolds one fan-fold or pleat at a time inside of the encapsulated package without worrying about the edge-folded ceiling liner sheet 10 being subject to a gust of wind, or folded-up edges 16 being caught at pinch points. An unused portion of the edge-folded ceiling liner sheet 10 remains protected in the encapsulated package 12. The fan-folded ceiling liner sheet 10 remains protected inside the encapsulated package 12 out of any wind and potential weather exposures. A board or other weight can be placed on the top of the encapsulated package 12 to provide a desired degree of resistance to the edge-folded ceiling liner sheet 10 within being pulled out of the encapsulated package 12.

Figure 5:
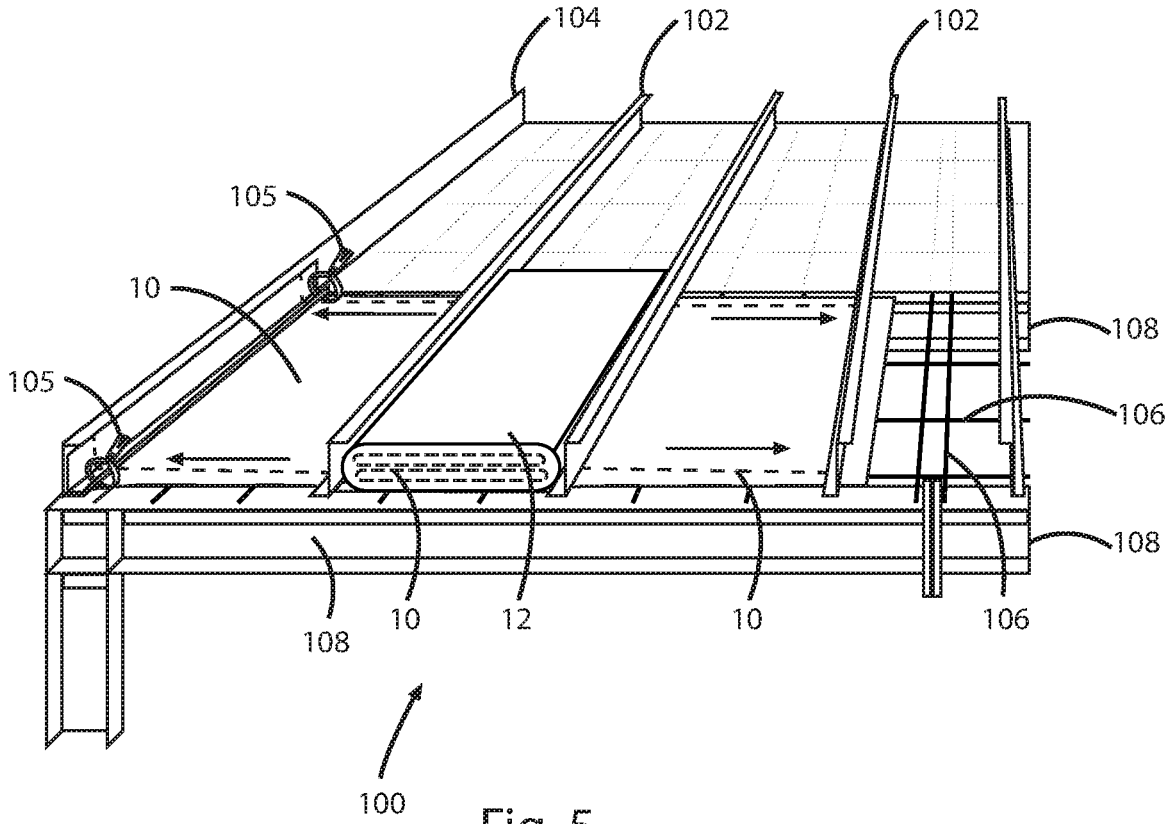
FIG. 5 is a perspective view an encapsulated package located between two adjacent purlins with an edge-folded ceiling liner sheet extending from opposing longwise sides of the encapsulated package of an insulation support system and a second edge-folded ceiling sheet installed, adjacent to encapsulated package in accordance with the present invention.
Figure 6:
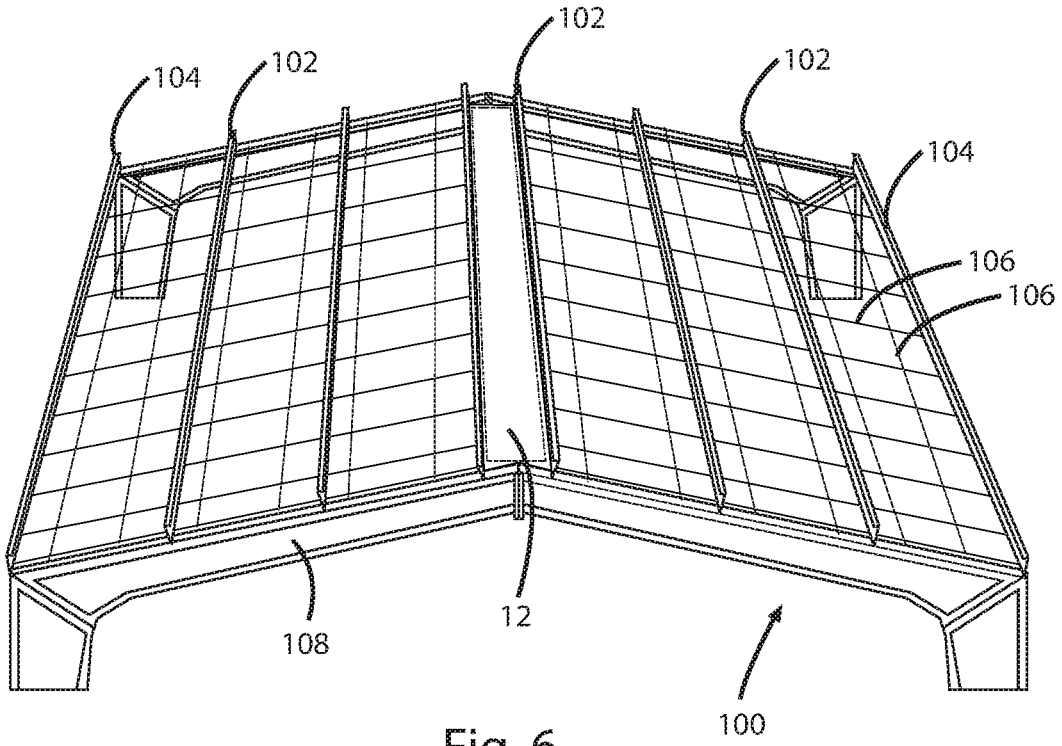
FIG. 6 is a perspective view a top of a metal building with an encapsulated package located between two adjacent purlins at a ridge thereof of an insulation support system in accordance with the present invention.
Figure 7:
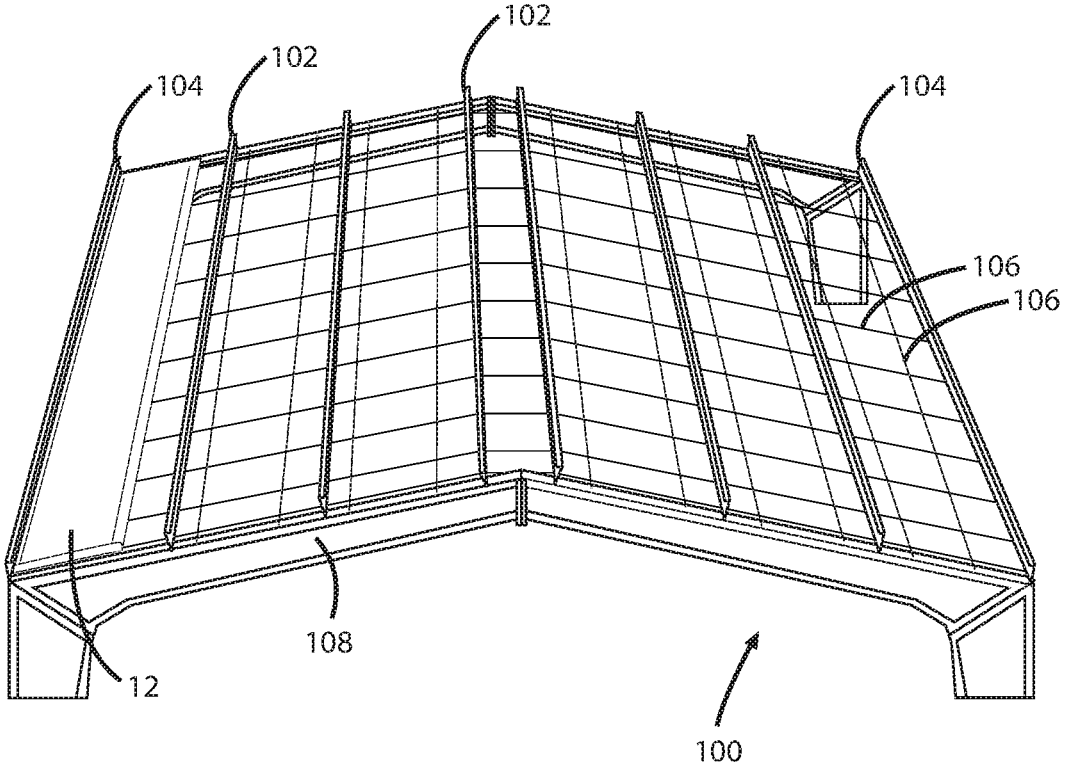
FIG. 7 is a perspective view a top of a metal building with an encapsulated package located between an eave purlin and a regular purlin of an insulation support system in accordance with the present invention.
Figure 8:
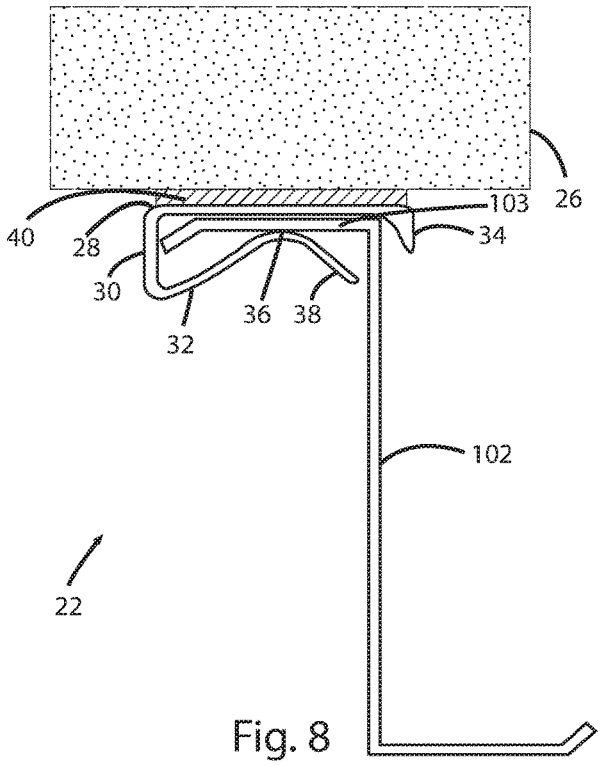
FIG. 8 is an end view of a pressure absorbing expansion spacer for attachment to a purlin of an insulation support system in accordance with the present invention.
Figure 9:
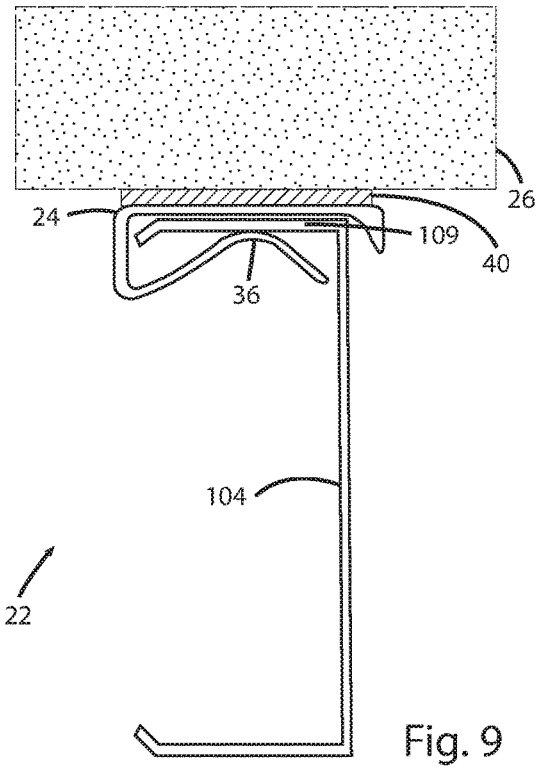
FIG. 9 is an end view of a pressure absorbing expansion spacer for attachment to an eave purlin of an insulation support system in accordance with the present invention.

With reference to FIGS. 4-5, another option is to clamp two opposing top end corners of the edge folded ceiling liner sheet 10 at the beginning end to the eave purlin 104 (secondary structural member) with C-clamp vise grips 105 and then pull the encapsulated package 12 on the plurality of support straps 106 (lattice support) as the edge-folded ceiling liner sheet 10 dispenses out of a trailing side sheet slot of the encapsulated package 12. A length of the encapsulated package 12 is less than a distance between the two adjacent rafters 108 (primary structural members) to avoid any interference with pulling the package or sheet along the plurality of support straps 106 (lattice support). With either option, once the edge-folded ceiling liner sheet 10 is pulled into position and clamped securely in position, bottom side fasteners are installed to attach the plurality of support straps 106 to bottoms of the purlins 102, at all intersection points, with fasteners penetrating through the steel strap and the edge-folded ceiling liner sheet 10 at each of those intersection points where a strap crosses under a purlin. The folded-up edges 16 are unfolded, trimmed as needed and sealed in final position at the top flanges of the rafters 108.

It is an option to install insulation from the interior of the building after roof panels 107 are installed. With reference to FIGS. 8-11 for this option to be used, there is a need for the application of a pressure absorbing expansion spacer 22 in the roofing process to prevent roof rumble noises. The pressure absorbing expansion spacer 22 preferably includes a snap clip 24 or any other suitable attachment means and a pressure absorbing expansion spacer material 26. The snap clip 24 preferably includes an upper leg 28, a base portion 30 and a lower leg 32. One end of the upper leg 28 extends outward from a top of the base portion 30 and one end of the lower leg 32 extends outward from a bottom of the base portion 30. A downward lip 34 extends downward from an opposing end of the upper leg 28 to engage a horizontal flange 103 of a purlin 102 or a horizontal flange 109 of a purlin 104 or the like. The lower leg 32 preferably includes a clamping portion 36 and an angled insertion end 38. The angled insertion end 38 extends from the clamping portion 36. The angled insertion end 38 facilitates quick insertion of the horizontal flange 103, 109 into the snap clip 24. The snap clip 24 is fabricated from a material with memory properties. Memory properties means that, after the snap clip 24 is opened to insert a horizontal flange 103, 109, it will return to its original shape. A bottom of the pressure absorbing expansion spacer 26 is pre-attached to the upper leg 28 of the snap clip 24 with adhesive, cement, double sided tape or the like 40. The snap clip 24 is preferably attached to the horizontal flange 103 of the purlin 102, the horizontal flange 109 of the purlin 104 or a linear structural member, before the roof panels 107 are applied. A ceiling sheet 132 supports insulation 130.

Figure 10:
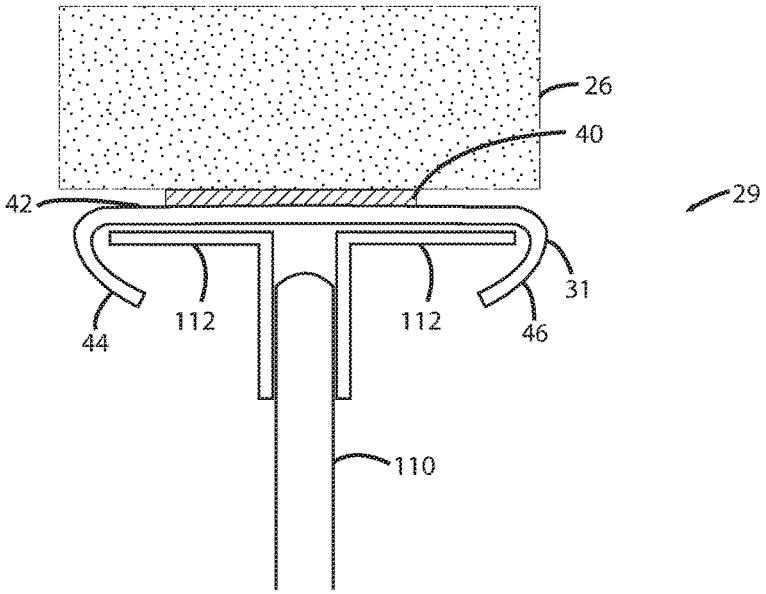
FIG. 10 is an end view of pressure absorbing expansion spacer for attachment to a joist style purlin of an insulation support system in accordance with the present invention.

With reference to FIG. 10, a joist style purlin 110 is shown with a snap clip 31 attached to two opposing horizontal flanges 112. The joist style purlin snap clip 31 includes a base member 42, a first end member 44 and a second end member 46. A clip-on pressure absorbing expansion spacer 29 preferably includes a snap clip 31 or any other suitable attachment means and the pressure absorbing expansion spacer material 26. The first end member 44 extends from a first end of the base member 42 and the second end member 44 extends from a second end of the base member 42. The joist style purlin snap clip 31 is fabricated from a material with memory properties. The first and second end members 44, 46 preferably include a curved contour, but other shapes may also be used. The pressure absorbing expansion spacer material 26 is attached to the base member 42 of the joist style purlin snap clip 31 with the adhesive, cement, double sided tape or the like 40. The pressure absorbing expansion spacers 22, 29 provide dampening of roof noise or roof rumble from rain and wind actions from the roof panels or from building movements.

Figure 11:
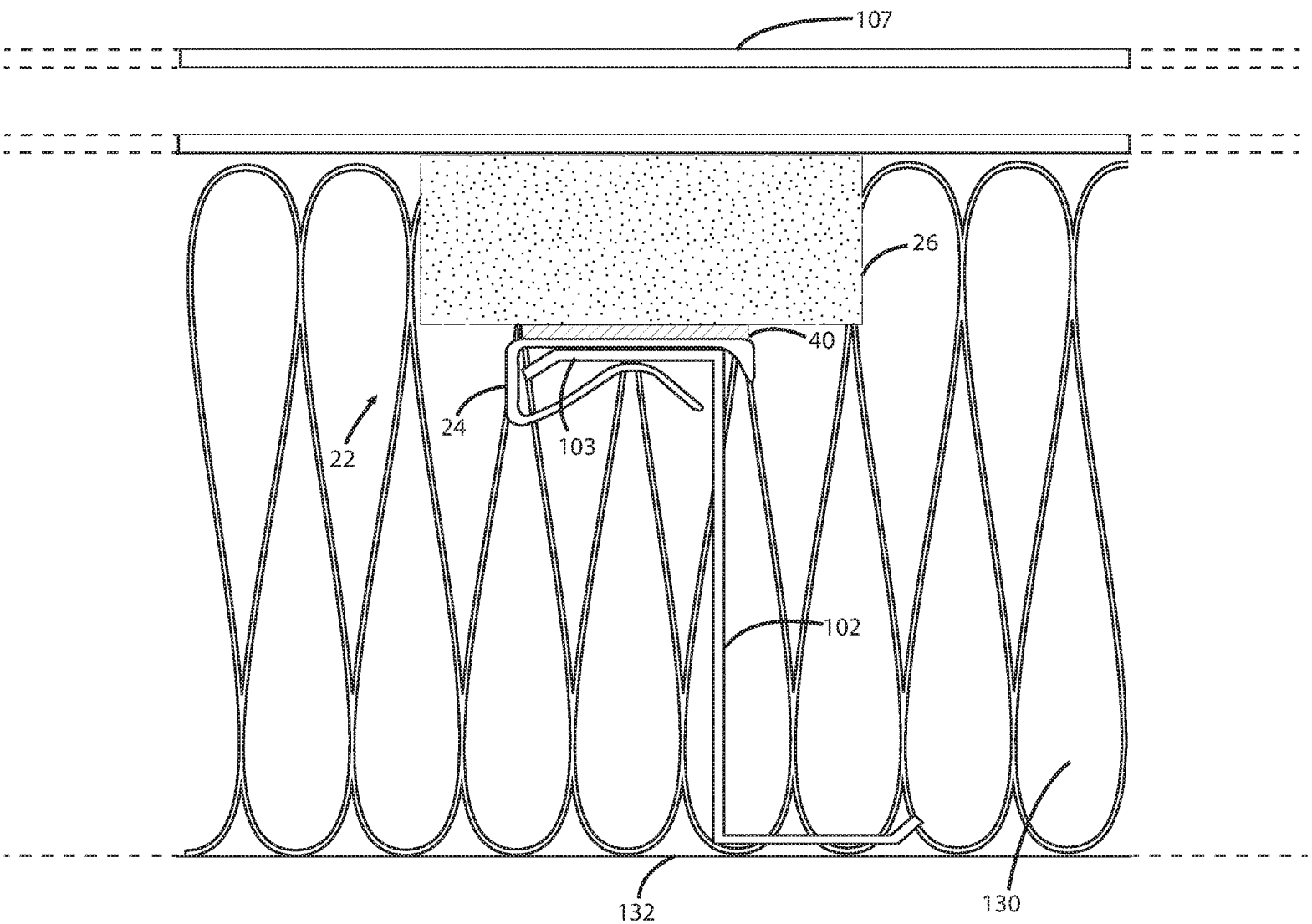
FIG. 11 is an end view of a pressure absorbing expansion spacer attached to a purlin of an insulation support system with a snap clip in accordance with the present invention.
Figure 11A:
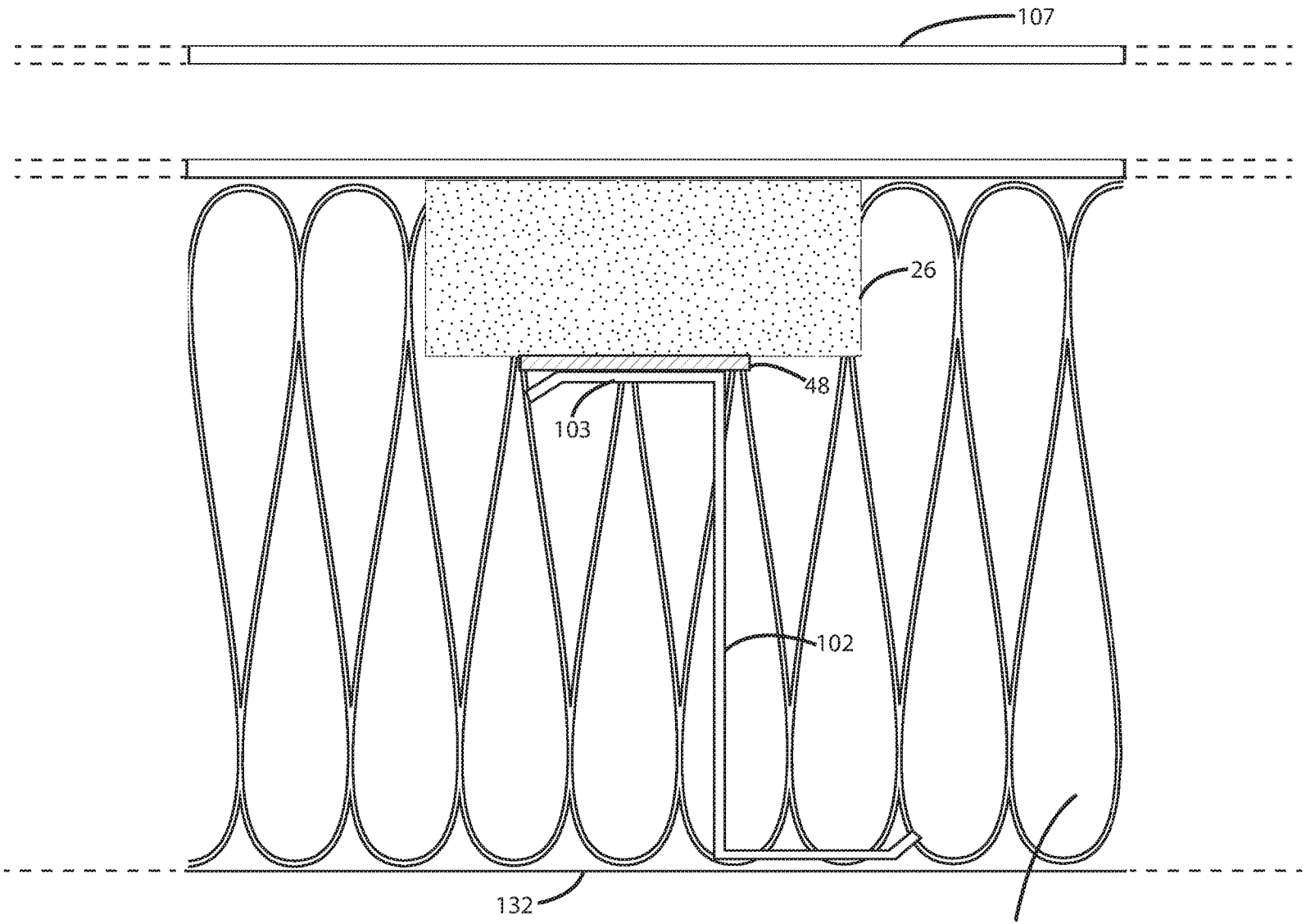
FIG. 11*a* is an end view of a pressure absorbing expansion spacer attached to a purlin of an insulation support system with adhesive, cement or double sided tape in accordance with the present invention.
Figure 11B:
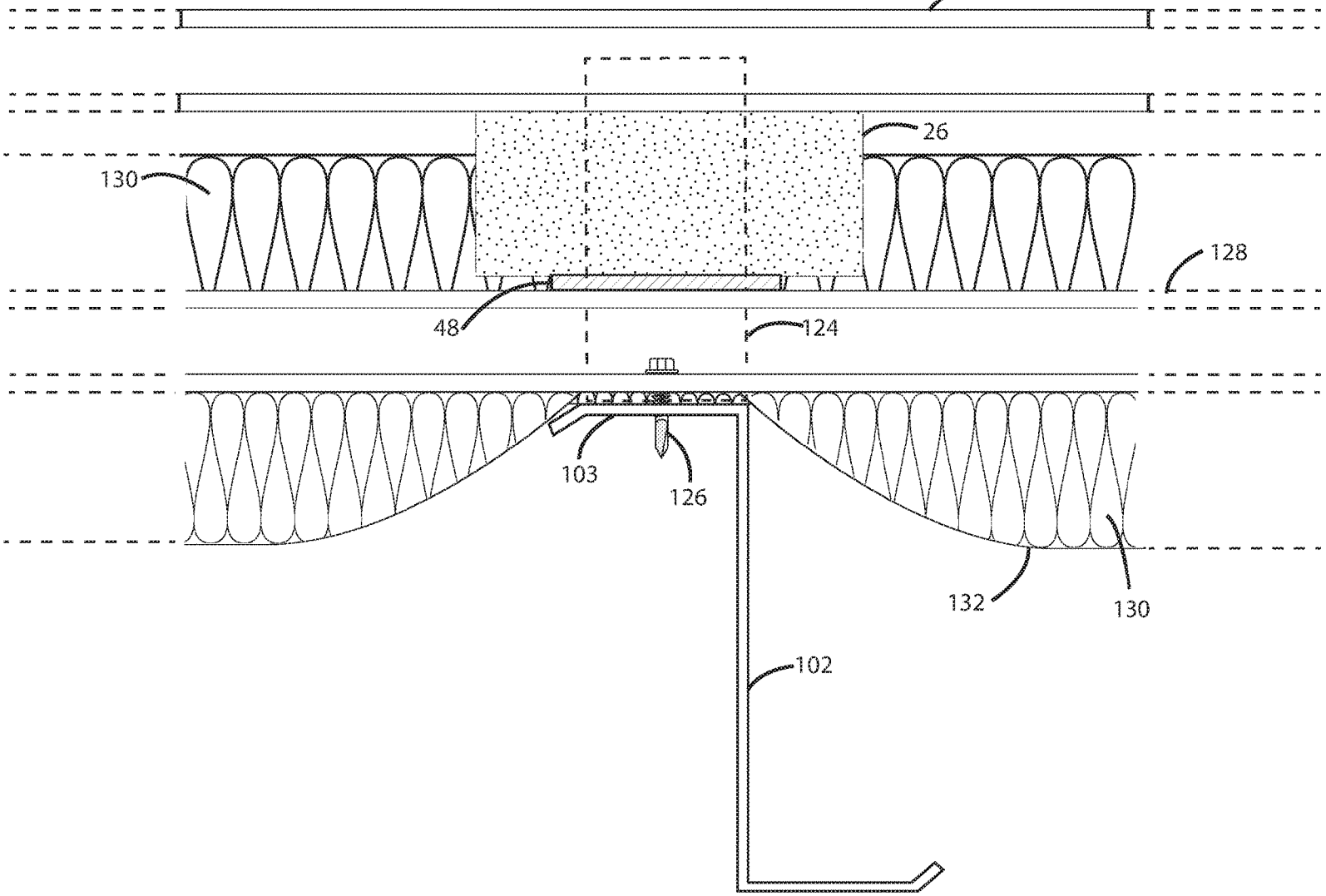
FIG. 11*b* is an end view of a pressure absorbing expansion spacer attached to a roof sheet and in contact with a newly added roof sheet in accordance with the present invention.

With reference to FIG. 11*a*, the pressure absorbing expansion spacer 26 may also be attached directly to the horizontal flange 103 with a bonding substance, double sided tape 48, adhesive or the, like. With reference to FIG. 11*b*, the pressure absorbing expansion spacer material 26 may also be attached directly to an existing roof sheet 128 or an adaptive fastening structure (not shown) with a bonding substance, double sided tape 48 or like. A replacement roof sheet 111 will flex during a high wind or undulating wind, which can result in very annoying thunder-like noises, without installation of the pressure absorbing expansion spacer 26. An adaptive structural bracket 124 may be used to attach the newly added roof sheet 111 to the existing roof sheet 128. A fastener 126 is used to attach the structural bracket 124 to the horizontal flange 103 of the roof purlin 102. Insulation 130 is placed above the existing roof sheet 128. An existing ceiling sheet 132 is used to support the existing insulation 130, below the existing roof sheet 128.

Figure 12:
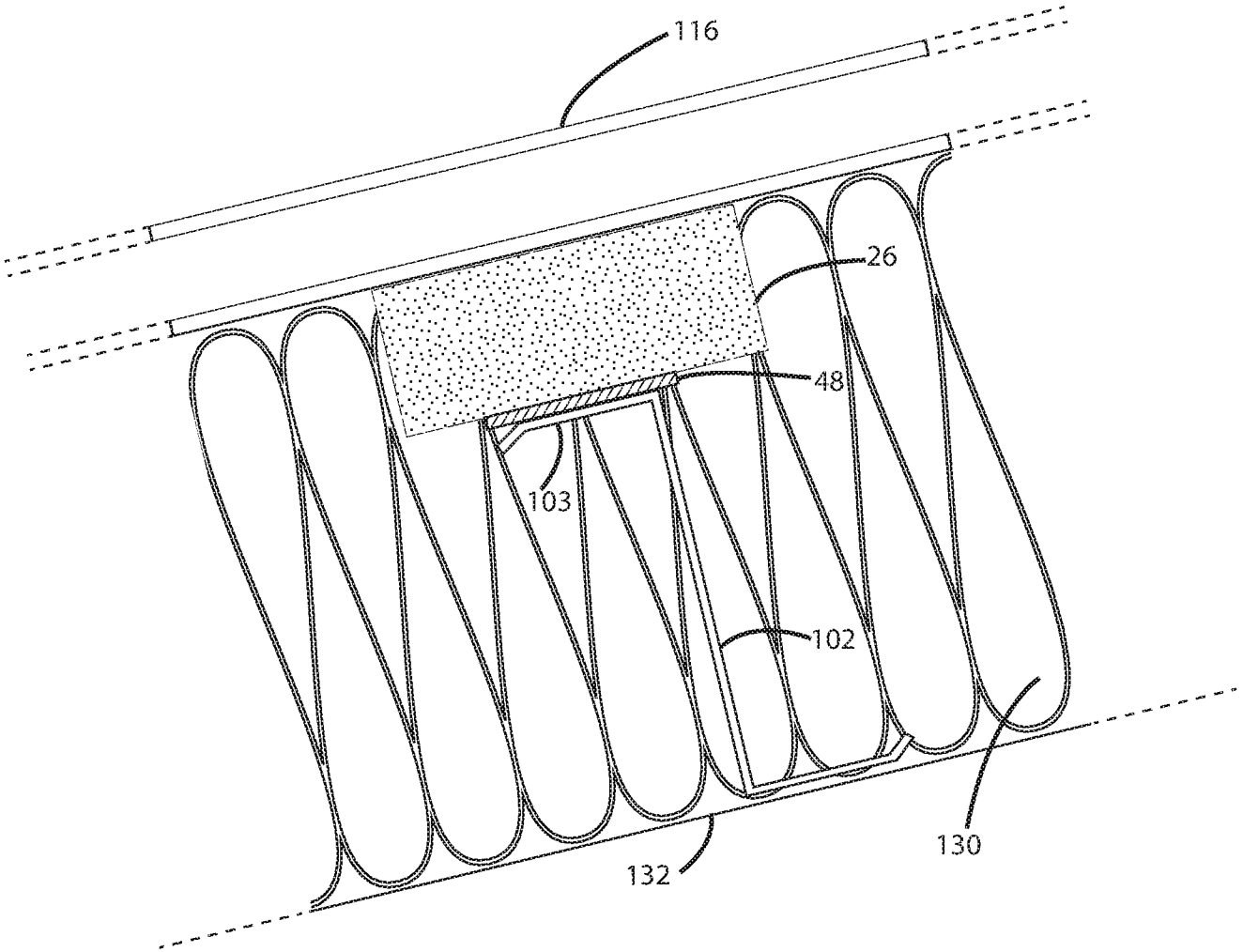
FIG. 12 is an end view of a pressure absorbing expansion spacer attached to an angled roof support and in contact with a sloped roof in accordance with the present invention.
Figure 12A:
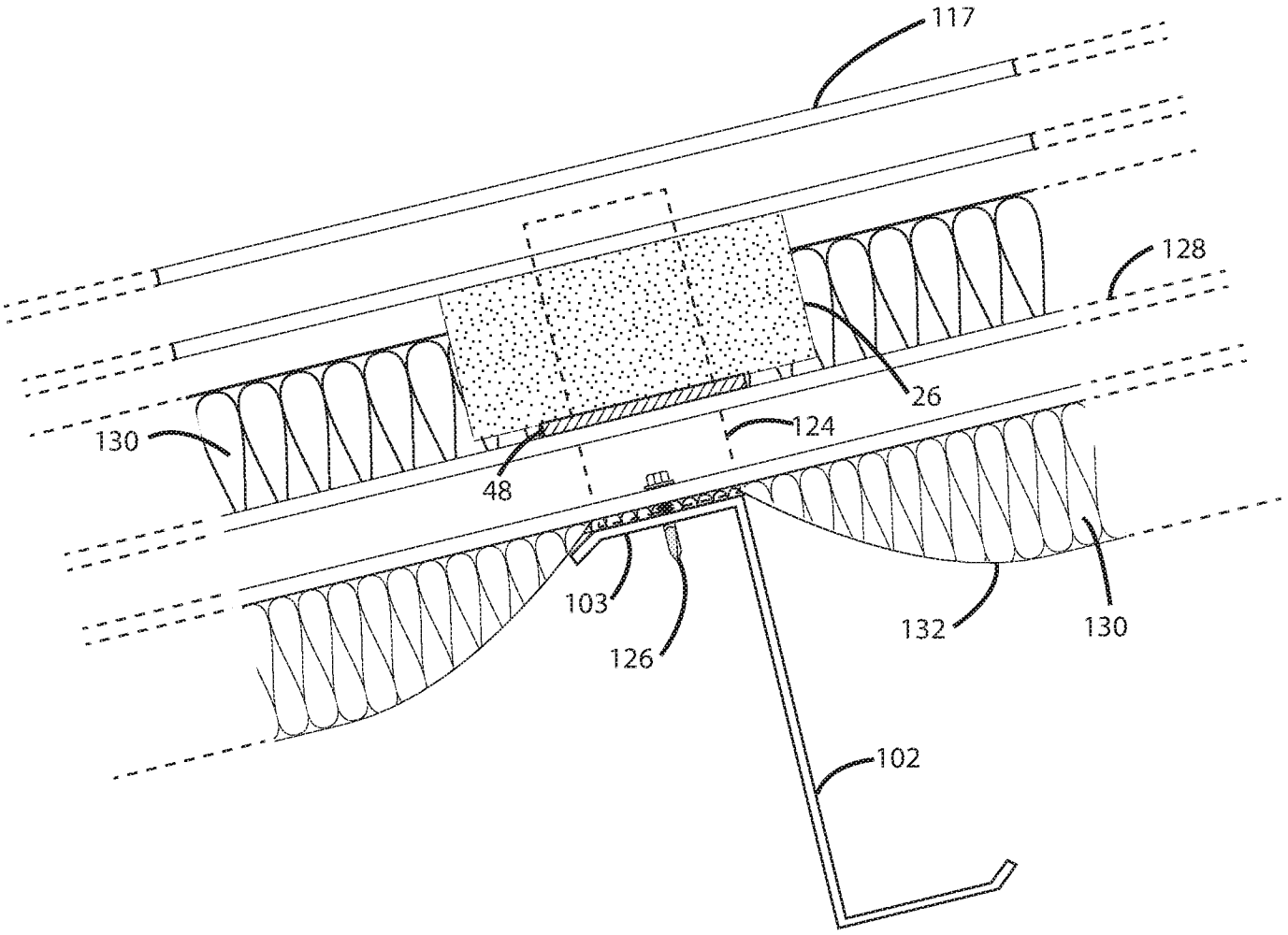
FIG. 12*a* is an end view of a pressure absorbing expansion spacer attached to a sloped roof and in contact with a newly added sloped roof sheet in accordance with the present invention.

With reference to FIG. 12, the pressure absorbing expansion spacer 26 is attached to the horizontal flange 103 of the roof purlin 102 with a bonding substance, double sided tape 48 or like. The pressure absorbing expansion spacer 26 is positioned, such that it makes contact with a sloped roof sheet 116. With reference to FIG. 12*a*, the pressure absorbing expansion spacer 26 is attached to an existing sloped roof sheet 128 with a bonding substance, double sided tape 48 or like. The pressure absorbing expansion spacer 26 is positioned, such that it makes contact with a newly added sloped roof sheet 117. A structural bracket 124 is used to attach a newly added roof sheet 117 to the existing roof sheet 128. A fastener 126 is used to attach the structural bracket 124 to the horizontal flange 103 of the roof purlin 102. Insulation is placed between the existing roof sheet 128 and the replacement roof sheet 117.

Figure 13:
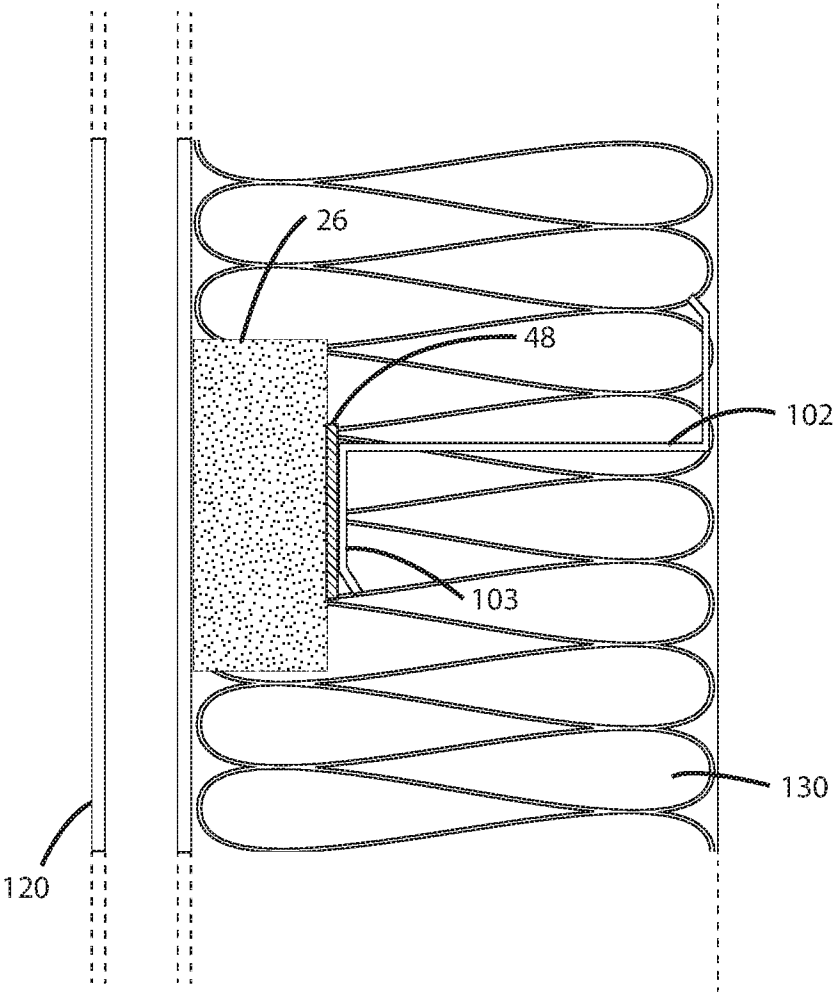
FIG. 13 is an end view of a pressure absorbing expansion spacer attached to a wall girt and contacting an outer wall sheet in accordance with the present invention.
Figure 13A:
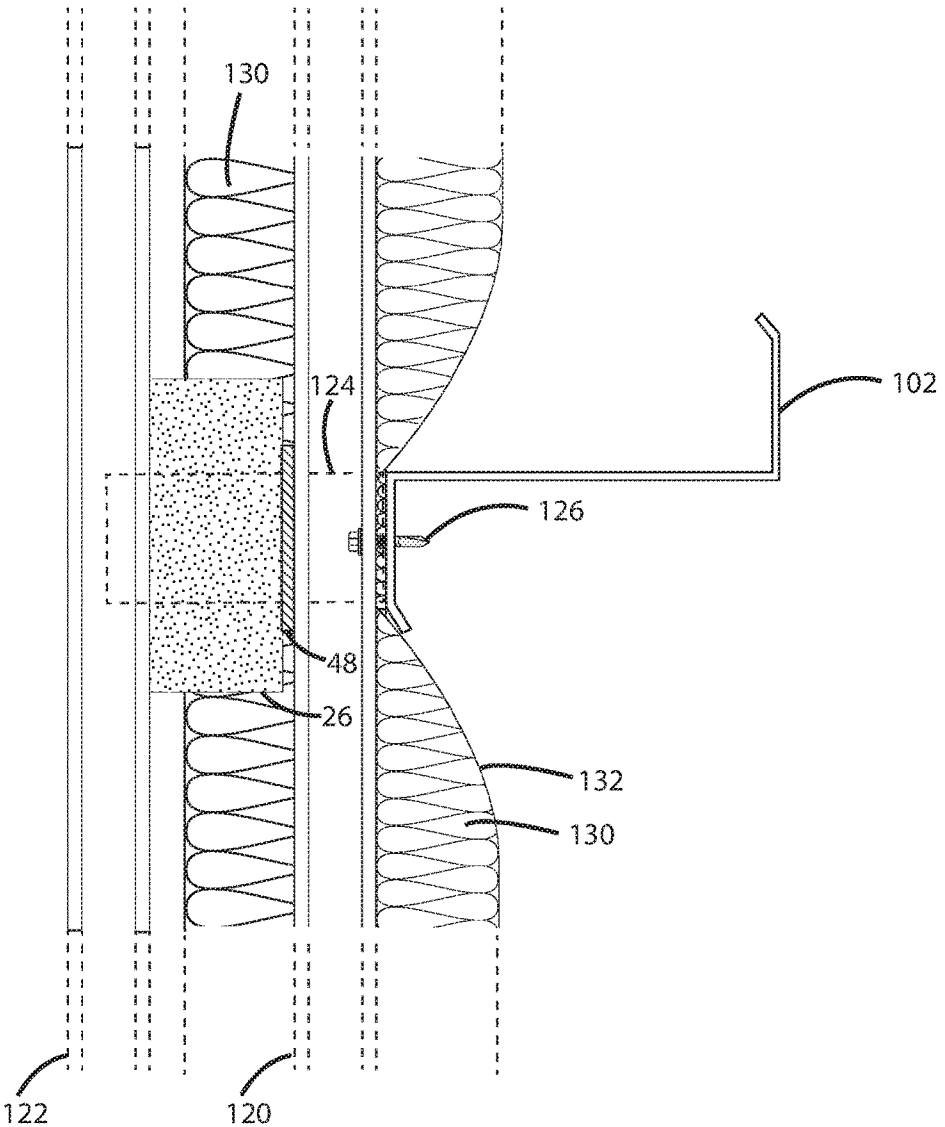
FIG. 13*a* is an end view of a pressure absorbing expansion spacer attached to an outer wall sheet and in contact with a newly added side wall sheet in accordance with the present invention.

With reference to FIG. 13, the pressure absorbing expansion spacer material 26 is attached to the vertical flange 103 of a horizontal wall purlin (girt) with a bonding substance, double sided tape 48 or like. The pressure absorbing expansion spacer material 26 is positioned, such that it makes contact with a new outside wall sheet 120. With reference to FIG. 13*a*, the pressure absorbing expansion spacer material 26 is attached to the existing wall sheet 120 with a bonding substance, double sided tape 48 or like. The pressure absorbing expansion spacer 26 is positioned, such that it makes contact with a new outside wall sheet 122. The structural bracket 124 is used to attach the new outside wall sheet 122 to the existing side wall sheet 120. The fastener 126 is used to attach the structural bracket 124 to the vertical flange 103 of the wall purlin (girt). New insulation 130 is placed between the existing wall sheet 120 and the new outside wall sheet 122.

The installation of these improvements to metal buildings allow for the rapid enclosure of the building with the least adverse effects of wind and other weather variables as the insulation can be substantially installed from the interior of the building by installing insulation on the edge folded ceiling liner sheet 10 over the rafters 108 to fill all cavities under the roof between two adjacent rafters 108 without adverse effects of weather on the qualities of optimal thermal performance or the insulation installation productivity. The installation of the pressure absorbing expansion spacer material 26 under building new roof sheets and wall sheet will dampen roof or wall noise, allow the new insulation 130 to be installed in the new or existing building roofs and walls without the need to severely compress thermal insulation and allow the thermal insulation to be installed at full thickness between the pressure absorbing expansion spacers to dampen roof and wall sheeting noises, achieve significant increased performance and reduce delays and costs.

It is preferable that in FIGS. 11, 11*a*, 11*b*, 12, 12*a*, 13 and 13*a* that the expansion spacer 26, be preloaded, such that a height of the expansion spacer 26 is decreased. The expansion spacer 26 is preloaded between the roof 107,116,128 or the wall 120, and a support structure 102,103, the second roof 111, 117 or the second wall 122. It is also preferable that the expansion spacer 26 have memory, such that it returns to its original shape, after removal from a compressed state. The expansion spacer provides resistive force against the movement of the support structure 102,103, the second roof 111, 117 or second wall 122.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of utilizing a pressure absorbing expansion spacer for preventing undulation of at least one sheeting panel relative to a roof or wall structural member, comprising the steps of:

installing said pressure absorbing expansion spacer between the roof or wall structural member and the at least one sheeting panel, said pressure absorbing expansion spacer being composed of a resilient material having memory properties, the roof or wall structural member is permanently attached to a rafter;

preloading said pressure absorbing expansion spacer between the at least one sheeting panel and the roof or wall structural member such that a height of said pressure absorbing spacer is decreased; and attaching said pressure absorbing expansion spacer to a flange of the roof or wall structural member via an attachment means;

wherein said pressure absorbing expansion spacer prevents the at least one sheeting panel from undulating relative to the roof or wall structural member, said pressure absorbing expansion spacer compresses and expands to maintain contact with at least one sheeting panel, which prevents undulation when said pressure absorbing expansion spacer makes contact with the at least one sheeting panel, wherein said pressure absorbing expansion spacer prevents noise caused by the undulation of the at least one sheeting panel relative to the roof or wall structural member.

2. The method of claim 1 wherein:

the attachment means is a snap clip, said pressure absorbing expansion spacer is attached to said snap clip with one of a bonding substance, double sided tape or adhesive.

3. The method of claim 1 wherein:

the roof or wall structural member is one of a purlin, girt and joist style purlin.

4. The method of claim 1 wherein:

the roof or wall structural member is a joist style purlin with two opposing top flange legs.

5. The method of claim 1 wherein:

thermal insulation is installed adjacent said pressure absorbing expansion spacer to add thermal performance to the roof or wall structural member and the at least one sheeting panel.

6. A method of utilizing a pressure absorbing expansion spacer for preventing undulation of at least one sheeting panel relative to a roof or wall structural member, comprising the steps of:

installing said pressure absorbing expansion spacer between the roof or wall structural member and the at least one sheeting panel, said pressure absorbing expansion spacer being composed of a resilient material having memory properties, the roof or wall structural member is permanently attached to a rafter;

preloading said pressure absorbing expansion spacer between the at least one sheeting panel and the roof or wall structural member such that a height of said pressure absorbing spacer is decreased; and attaching said pressure absorbing expansion spacer to a flange of the roof or wall structural member via an attachment means;

wherein said pressure absorbing expansion spacer prevents the at least one sheeting panel from undulating relative to the roof or wall structural member, wherein said pressure absorbing expansion spacer provides a resistive force against movement of the at least one sheeting panel, wherein said pressure absorbing expansion spacer prevents noise caused by the undulation of the at least one sheeting panel relative to the roof or wall structural member.

7. The method of claim 6 wherein:

the attachment means is a snap clip, said pressure absorbing expansion spacer is attached to said snap clip with one of a bonding substance, double sided tape or adhesive.

8. The method of claim 6 wherein:

the roof or wall structural member is one of a purlin, girt and joist style purlin.

9. The method of claim 6 wherein:

the roof or wall structural member is a joist style purlin with two opposing top flange legs.

10. The method of claim 6 wherein:

thermal insulation is installed adjacent said pressure absorbing expansion spacer to add thermal performance to the roof or wall structural member and the at least one sheeting panel.

11. A method of utilizing a pressure absorbing expansion spacer for preventing undulation of at least one sheeting panel relative to a roof or wall structural member, comprising the steps of:

installing said pressure absorbing expansion spacer between the roof or wall structural member and the at least one sheeting panel, said pressure absorbing expansion spacer being composed of a resilient material having memory properties, the roof or wall structural member is permanently attached to a rafter;

preloading said pressure absorbing expansion spacer between the at least one sheeting panel and the roof or wall structural member such that a height of said pressure absorbing spacer is decreased;

attaching said pressure absorbing expansion spacer to a flange of the roof or wall structural member via an attachment means;

wherein said pressure absorbing expansion spacer prevents the at least one sheeting panel from undulating relative to the roof or wall structural member, said pressure absorbing expansion spacer resists movement of the at least one sheeting panel, wherein said pressure absorbing expansion spacer prevents noise caused by the undulation of the at least one sheeting panel relative to the roof or wall structural member.

12. The method of claim 11 wherein:

the attachment means is a snap clip, said pressure absorbing expansion spacer is attached to said snap clip with one of a bonding substance, double sided tape or adhesive.

13. The method of claim 11 wherein:

the roof or wall structural member is one of a purlin, girt and joist style purlin.

14. The method of claim 11 wherein:

the roof or wall structural member is a joist style purlin with two opposing top flange legs.

15. The method of claim 11 wherein:

thermal insulation is installed adjacent said pressure absorbing expansion spacer to add thermal performance to the roof or wall structural member and the at least one sheeting panel.

* * * * *